US007106032B2

(12) United States Patent
Chen et al.

(10) Patent No.: US 7,106,032 B2
(45) Date of Patent: Sep. 12, 2006

(54) LINEAR VOLTAGE REGULATOR WITH SELECTABLE LIGHT AND HEAVY LOAD PATHS

(75) Inventors: Tien-Tzu Chen, Hsinchu (TW); Fang-Te Su, Hsinchu (TW)

(73) Assignee: Aimtron Technology Corp., Hsinchu (TW)

( * ) Notice: Subject to any disclaimer, the term of this patent is extended or adjusted under 35 U.S.C. 154(b) by 91 days.

(21) Appl. No.: 10/906,093

(22) Filed: Feb. 3, 2005

(65) Prior Publication Data

US 2006/0170401 A1 Aug. 3, 2006

(51) Int. Cl.
*G05F 1/40* (2006.01)

(52) U.S. Cl. ..... 323/269

(58) Field of Classification Search ..... 323/265, 323/268, 269, 274, 276, 277
See application file for complete search history.

(56) References Cited

U.S. PATENT DOCUMENTS 4,779,037 A * 10/1988 LoCascio ..... 323/275
5,528,127 A 6/1996 Streit
6,246,221 B1 6/2001 Xi
6,469,480 B1 10/2002 Kanakubo
6,677,735 B1 1/2004 Xi
6,677,737 B1 1/2004 Hamon et al.
6,806,690 B1 10/2004 Xi

* cited by examiner

*Primary Examiner*—Shawn Riley
(74) *Attorney, Agent, or Firm*—Winston Hsu

(57) ABSTRACT

A light-load power transistor and a heavy-load power transistor are connected in parallel between an input voltage and an output voltage. The light-load power transistor has a smaller current driving capability, i.e. a smaller dimension of a current path. During a light-load mode, only is the light-load power transistor activated to reduce the current consumption caused by an error amplifier, thereby enhancing the efficiency. When a detection current signal is higher than a threshold current signal, the heavy-load power transistor is additionally activated through a gate control circuit by a mode selection circuit, thereby achieving a sufficient current driving capability.

10 Claims, 3 Drawing Sheets

LINEAR VOLTAGE REGULATOR WITH SELECTABLE LIGHT AND HEAVY LOAD PATHS

BACKGROUND OF THE INVENTION

1. Field of the Invention

The present invention relates to a linear voltage regulator and, more particularly, to a linear voltage regulator capable of enhancing the efficiency during a light-load mode.

2. Description of the Related Art

Voltage regulators supply a required output current at a regulated output voltage to a load. Linear voltage regulators employ a power transistor operated in the ohmic region as a passive device. The output voltage is fed back to control a variable resistance of the power transistor for obtaining the regulated output voltage from an input voltage, e.g. a battery voltage, minus a potential difference across the variable resistance. During a light-load mode, the necessary output current is reduced but the current consumption of an error amplifier remains unchanged. Therefore, the conventional linear voltage regulator has a poor efficiency during the light-load mode.

FIG. 1 is a detailed circuit diagram showing a conventional linear voltage regulator 10. As shown in FIG. 1, the conventional linear voltage regulator 10 has a power transistor 11 connected between an input voltage $V_{in}$ and an output terminal A. The power transistor 11 has a gate controlled by an error signal $V_{err}$ generated from an output terminal of an error amplifier 12. The error amplifier 12 has an inverting input terminal for receiving a reference voltage signal $V_{ref}$, and a non-inverting input terminal for receiving a feedback voltage signal $V_{fb}$. Consequently, the error signal $V_{err}$ generated by the error amplifier 12 is a representative of the difference between the feedback voltage signal $V_{fb}$ and the reference voltage signal $V_{ref}$. The reference voltage signal $V_{ref}$ is determined by a reference voltage generator and has a constant voltage level. As a representative of an output voltage $V_{out}$, the feedback voltage signal $V_{fb}$ is generated by a feedback circuit 14 connected to the output terminal A. For example, the feedback circuit 14 may be implemented by a resistive voltage divider using two resistors connected in series between the output terminal A and a ground potential for providing a voltage division $[R2/(R1+R2)]*V_{out}$ as the feedback voltage signal $V_{fb}$. Therefore, the linear voltage regulator 10 supplies the necessary output current $I_{out}$ through the power transistor 11 to a load 15. In order to improve ripples of the regulated output voltage $V_{out}$, a capacitor $C_o$ may be installed between the output terminal A and the ground potential.

In response to the in-time current requirement by the load 15, the linear voltage regulator 10 supplies a larger or smaller output current $I_{out}$ with the output voltage $V_{out}$ regulated at $[(R1+R2)/R2]*V_{ref}$. For achieving a sufficient current driving capability so as to supply a larger output current $I_{out}$, the power transistor 11 must have a large enough dimension. However, the large-dimension power transistor 11 causes a larger gate capacitance. For more appropriately controlling the gate of the power transistor 11, the error amplifier 12 must be designed to have a smaller output impendence, which results in a larger current consumption. Therefore, when the linear voltage regulator 11 is operated in the light-load mode, i.e. the output current $I_{out}$ is tiny or close to zero, the efficiency of the linear voltage regulator 10 deteriorates due to the large current consumption caused by the error amplifier 12.

Therefore, it is desired to develop a linear voltage regulator capable of enhancing the efficiency during a light-load mode.

SUMMARY OF THE INVENTION

In view of the above-mentioned problems, an object of the present invention is to provide a linear voltage regulator capable of achieving an optimum efficiency during a light-load mode.

Another object of the present invention is to provide a linear voltage regulator capable of achieving a sufficient current driving capability.

According to one aspect of the present invention, a linear voltage regulator employs two power transistors connected in parallel between an input voltage and an output voltage. One of the power transistors has a larger current driving capability, i.e. a larger dimension of a current path, and the other has a smaller current driving capability, i.e. a smaller dimension of a current path. During a light-load mode, the linear voltage regulator according to the present invention activates nothing but the power transistor having the smaller current driving capability to reduce the current consumption of an error amplifier, thereby enhancing the efficiency.

Furthermore, the linear voltage regulator according to the present invention employs a current sensing unit for detecting a current flowing through the power transistor having the smaller current driving capability. When the current detected by the current sensing unit is larger than a predetermined threshold current value, it is concluded that the linear voltage regulator is operated in a heavy-load mode. During the heavy-load mode, the power transistor having the larger current driving capability is additionally activated through a gate control circuit by a mode selection circuit, thereby providing a large enough output current to a load.

BRIEF DESCRIPTION OF THE DRAWINGS

The above-mentioned and other objects, features, and advantages of the present invention will become apparent with reference to the following descriptions and accompanying drawings, wherein.

DETAILED DESCRIPTION OF THE PREFERRED EMBODIMENTS

The preferred embodiments according to the present invention will be described in detail with reference to the drawings.

Figure 1:
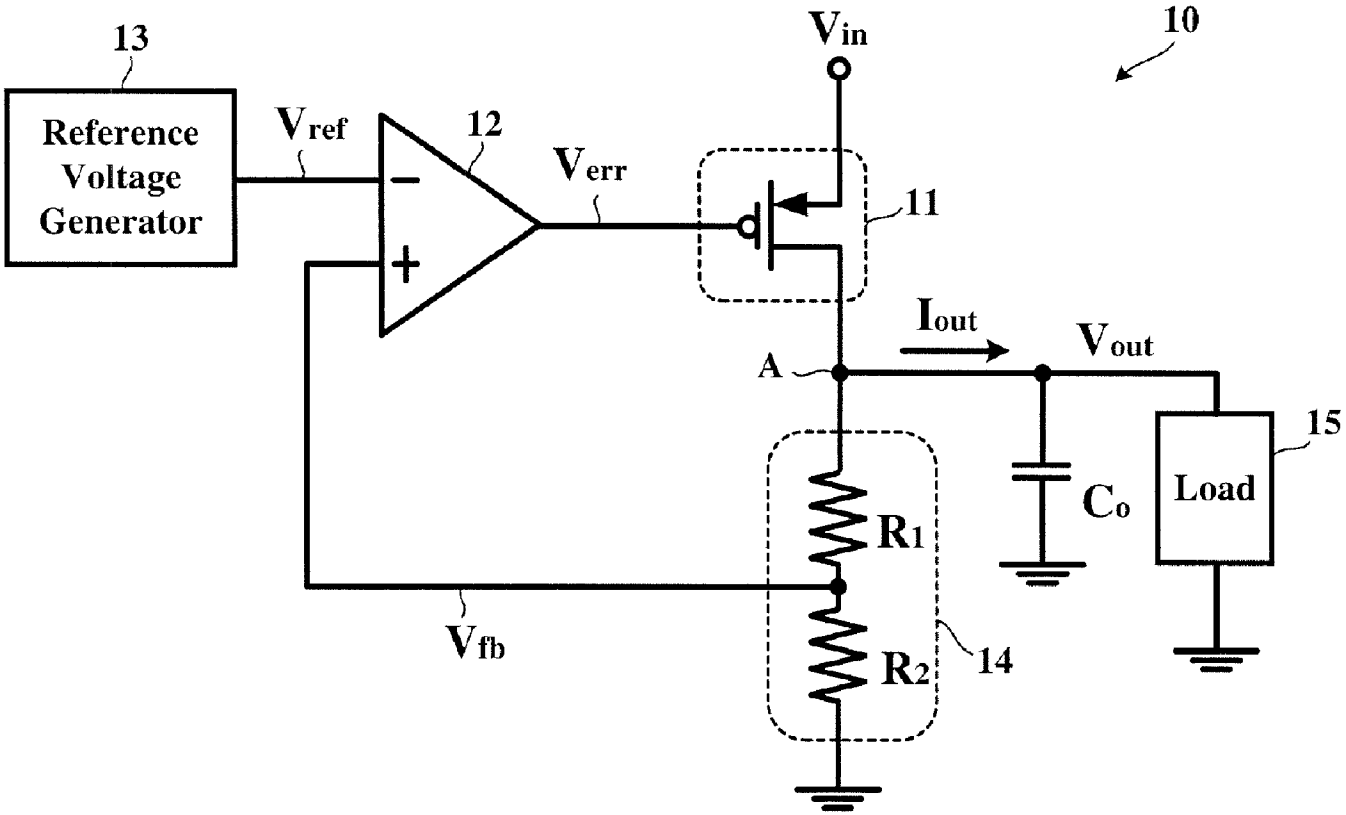
FIG. 1 (PRIOR ART)
FIG. 1 is a detailed circuit diagram showing a conventional linear voltage regulator.
Figure 2:
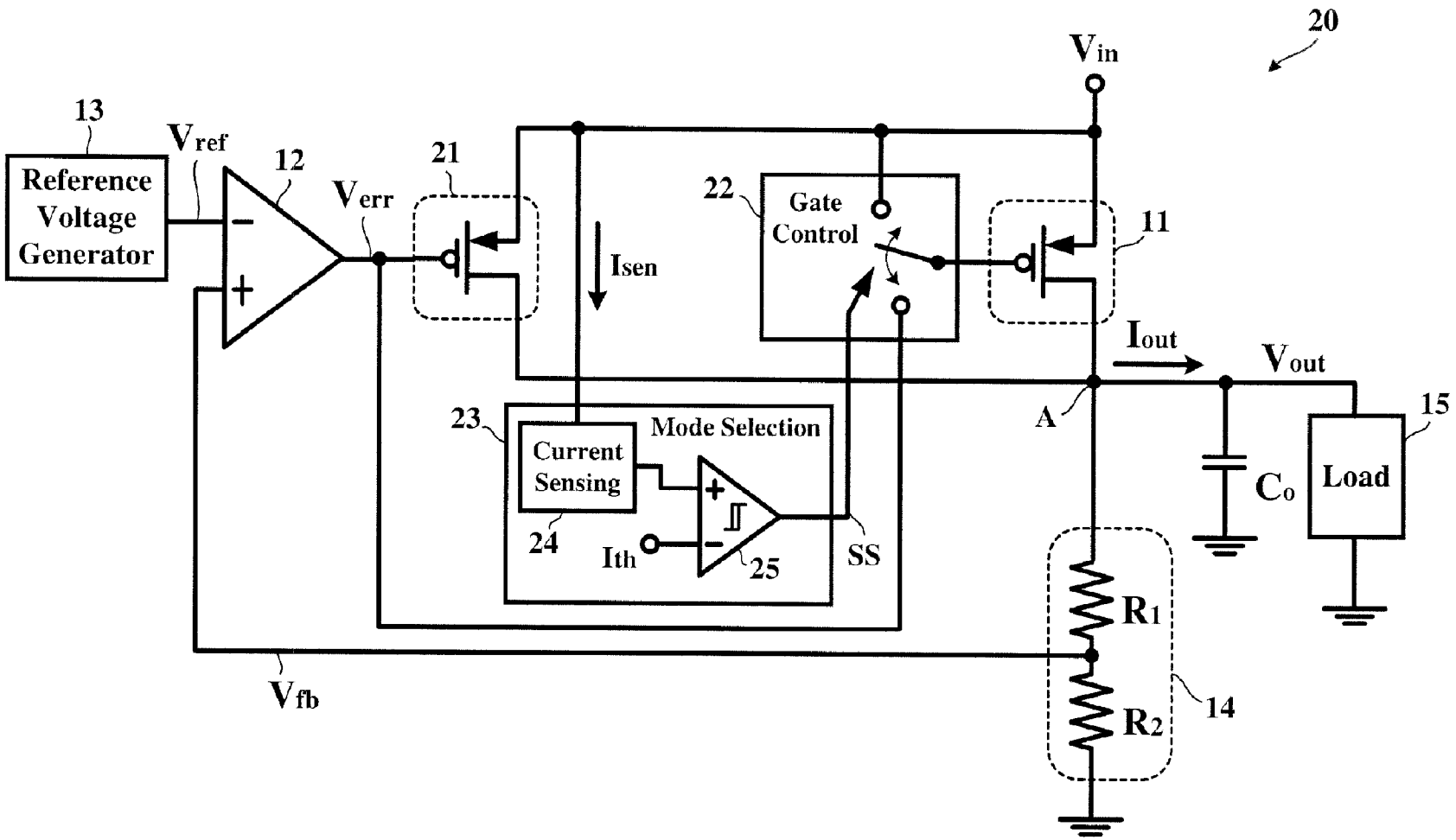
FIG. 2 is a circuit block diagram showing a linear voltage regulator according to the present invention.

FIG. 2 is a circuit block diagram showing a linear voltage regulator 20 according to the present invention. In FIG. 2, for simplicity, like reference numerals have been used to identify like components illustrated in FIG. 1 and previously described, with additional detail being shown in the timing and control portion of the circuit relevant to the present invention. The linear voltage regulator 20 according to the present invention has a heavy-load power transistor 11 and a light-load power transistor 21, both connected in parallel between the input voltage $V_{in}$ and the output terminal A. The dimension of the light-load power transistor 21 is designed to be smaller than that of the heavy-load power transistor 11, resulting in that the current driving capability of the light-load power transistor 21 to be smaller than that of the heavy-load power transistor 11. In a preferred embodiment, the current driving capability of the heavy-load power transistor 11 is designed to be five times larger than that of the light-load power transistor 21. The gate of the light-load power transistor 21 is directly connected to the output terminal of the error amplifier 12 and therefore controlled by the error signal $V_{err}$. However, the gate of the heavy-load power transistor 11 is indirectly connected through a gate control circuit 22 either to the output terminal of the error amplifier 12 and then is controlled by the error signal $V_{err}$, or to the input voltage $V_{in}$ and then is turned off.

The gate control circuit 22 is controlled by a mode selection signal SS output from a mode selection circuit 23, for determining whether the gate of the heavy-load power transistor 11 is connected to the output terminal of the error amplifier 12 or to the input voltage $V_{in}$. More specifically, the mode selection circuit 23 may be considered as a circuit external to the linear voltage regulator 20, which detects the current flowing through the light-load power transistor 21 and then modulates the mode selection signal SS so as to determine whether to activate the heavy-load power transistor 11 or not, thereby effectively achieving an optimum efficiency during the light-load mode as well as a sufficient current driving capability during the heavy-load mode.

The mode selection circuit 23 may include a current sensing unit 24 and a current comparing unit 25. The current sensing unit 24 generates a detection current signal $I_{sen}$, which is proportional to the current flowing through the light-load power transistor 21. The current comparing unit 25 compares the detection current signal $I_{sen}$ with a predetermined threshold current signal $I_{th}$. When the detection current signal $I_{sen}$ is smaller than the threshold current signal $I_{th}$, i.e. the linear voltage regulator 20 is operated in the light-load mode, the mode selection signal SS causes the gate control circuit 22 to prevent the error signal $V_{err}$ from being supplied to the heavy-load power transistor 11 and to turn off the heavy-load power transistor 11. In this case, the error amplifier 12 needs to control nothing but the light-load power transistor 21 having the smaller dimension, and therefore its current consumption is reduced. Since the necessary output current $I_{out}$ is tiny during the light-load mode, simply is the light-load power transistor 21 enough to meet the requirement of the current driving capability. When the detection current signal $I_{sen}$ is larger than the threshold current signal $I_{th}$, i.e. the linear voltage regulator 20 is operated in the heavy-load mode, the mode selection signal SS causes the gate control circuit 22 to allow the error signal $V_{err}$ to be supplied to the heavy-load power transistor 11. As a result, the error amplifier 12 controls both of the light-load power transistor 21 and the heavy-load power transistor 11 for effectively supplying a large enough output current $I_{out}$ during the heavy-load mode.

Therefore, the linear voltage regulator 20 according to the present invention effectively achieves an optimum efficiency during the light-load mode as well as a sufficient current driving capability during the heavy-load mode.

Figure 3:
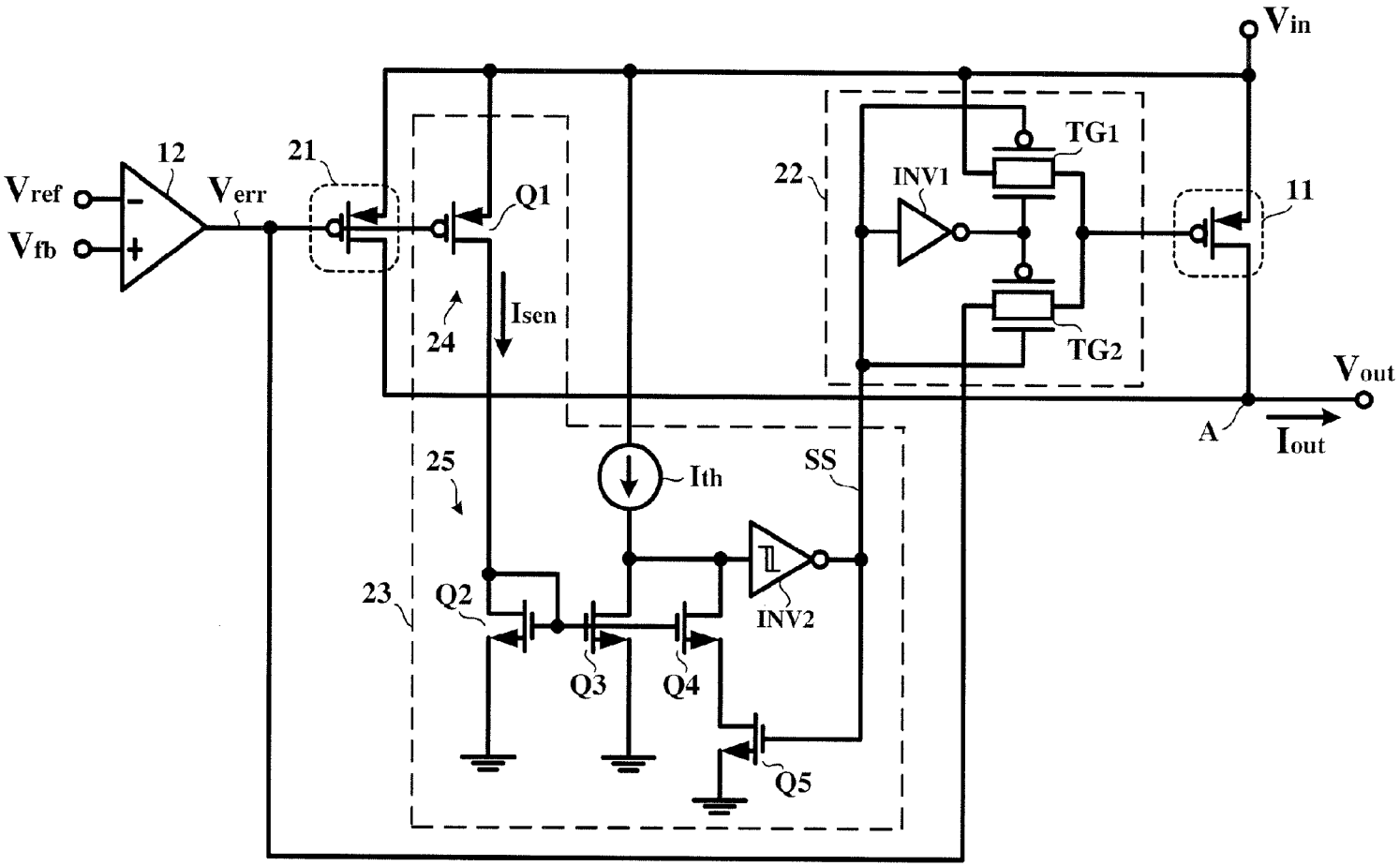
FIG. 3 is a detailed circuit diagram showing a gate control circuit and a mode selection circuit according to the present invention.

FIG. 3 is a detailed circuit diagram showing the gate control circuit 22 and the mode selection circuit 23 according to the present invention. In FIG. 3, for simplicity, like reference numerals have been used to identify like components illustrated in FIG. 2 and previously described. The gate control circuit 22 has two transmission gates TG1 and TG2. The gate of the heavy-load power transistor 11 is coupled to the input voltage $V_{in}$ through the transmission gate TG1, and to the output terminal of the error amplifier 12 through the transmission gate TG2 for receiving the error signal $V_{err}$. Whether the transmission gate TG1 or the transmission gate TG2 is made conductive is determined in response to the mode selection signal SS from the mode selection circuit 23. The mode selection signal SS has a first state, e.g. a low voltage level, and a second state, e.g. a high voltage level. When the mode selection signal SS is at the first state, the transmission gate TG1 is made conductive but the transmission gate TG2 is made nonconductive. In this case, the gate of the heavy-load power transistor 11 is coupled to the input voltage $V_{in}$ through the transmission gate TG1 such that the heavy-load power transistor 11 is turned off, and therefore the linear voltage regulator 20 is operated in the light-load mode. When the mode selection signal SS is at the second state, the transmission gate TG1 is made nonconductive but the transmission gate TG2 is made conductive. In this case, the gate of the heavy-load power transistor 11 is controlled by the error signal $V_{err}$ through the transmission gate TG2 and therefore the linear voltage regulator 20 is operated in the heavy-load mode. Hence, in response to the mode selection signal SS, the gate control circuit 22 effectively either allows the input voltage $V_{in}$ through the transmission gate TG1 to control the gate of the heavy-load power transistor 11 or allows the error signal $V_{err}$ through the transmission gate TG2 to control the gate of the heavy-load power transistor 11.

In the preferred embodiment shown in FIG. 3, the current sensing unit 24 of the mode selection circuit 23 is implemented by a PMOS transistor Q1. The transistor Q1 has a gate connected to the gate of the light-load power transistor 21, and a source connected to the source of the light-load power transistor 21. Consequently, a drain of the transistor Q1 is able to supply the detection current signal $I_{sen}$, which is proportional to the current flowing through the light-load power transistor 21.

In the preferred embodiment shown in FIG. 3, the current comparing unit 25 is designed to perform a hysteresis effect in regard to the current comparison, thereby preventing the undesirable noise occurred at transient periods when the light-load and heavy-load modes are interchanged. More specifically, the current comparing unit 25 carries out the comparison of the detection current signal $I_{sen}$ and the threshold current signal $I_{th}$ through using a current mirror formed of NMOS transistors Q2 and Q3. The transistors Q2 and Q3 have gates coupled together and sources coupled to the ground potential. The transistor Q2 has a drain for receiving the detection current signal $I_{sen}$ while the transistor Q3 has a drain for receiving the threshold current signal $I_{th}$. During the light-load mode, the potential at the drain of the transistor Q3 is pulled up toward the input voltage $V_{in}$ because the detection current signal $I_{sen}$ is smaller than the threshold current signal $I_{th}$. In this case, the mode selection signal SS output from an inverter INV2 is at a low voltage level such that the transmission gate TG1 is made conductive and the transmission gate TG2 is made nonconductive. As a result, the gate of the heavy-load power transistor 11 is coupled to the input voltage $V_{in}$ through the transmission gate TG1 for turning off the heavy-load power transistor 11. When the detection current signal $I_{sen}$ is larger than the threshold current signal $I_{th}$, the potential at the drain of the transistor Q3 is pulled down toward the ground potential. In this case, the mode selection signal SS output from the inverter INV2 is at the high voltage level such that the transmission gate TG1 is made nonconductive and the transmission gate TG2 is made conductive. As a result, the gate of the heavy-load power transistor 11 is controlled by the error signal $V_{err}$ through the transmission gate TG2 for operating the linear voltage regulator 20 in the heavy-load mode.

For preventing the undesirable noise occurred at transient periods when the detection current signal $I_{sen}$ is larger or smaller than the threshold current signal $I_{th}$, the current comparing unit 25 is further provided with NMOS transistors Q4 and Q5 for performing the hysteresis effect in regard to the current comparison. More specifically, the transistor Q4 has a gate and a drain connected respectively to the gate and the drain of the transistor Q3. The transistor Q5 functions as a switch under the control of the mode selection signal SS output from the inverter INV2. When the mode selection signal SS is at the low voltage level, the switching transistor Q5 is turned off for preventing the transistor Q4 from forming a current path. In this case, the detection current signal $I_{sen}$ is inevitably smaller than the threshold current signal $I_{th}$ so as to support the potential at the drain of the transistor Q3 at the high voltage level. Once the detection current signal $I_{sen}$ increases over the threshold current signal $I_{th}$, the potential at the drain of the transistor Q3 is reduced such that the mode selection signal SS is changed to the high voltage level. In this case, the switching transistor Q5 is turned on by the high-level mode selection signal SS for allowing the transistor Q4 to form a current path, which in effect causes the potential at the drain of the transistor Q3 to reduce further. Even if, during the transient period, the detection current signal $I_{sen}$ is reduced to become slightly smaller than the threshold current signal $I_{th}$ due to any kinds of disturbance or interference, the potential at the drain of the transistor Q3 is effectively prevented from being pulled up to cause the state transition of the mode selection signal SS because the current path provided by the transistor Q4 is able to accommodate part of the threshold current signal $I_{th}$.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A linear voltage regulator comprising:

a light-load transistor having a gate and a light-load current path coupled between an input voltage and an output voltage;

an error amplifier for generating an error signal in response to a reference voltage signal and a feedback voltage signal representative of the output voltage, the error signal controlling the gate of the light-load transistor;

a heavy-load transistor having a gate and a heavy-load current path coupled between the input voltage and the output voltage;

a gate control circuit coupled to the gate of the heavy-load transistor; and a mode selection circuit coupled between the error amplifier and the gate control circuit for generating a detection current signal representative of a current flowing through the light-load transistor such that when the detection current signal is larger than a predetermined threshold current signal, the mode selection circuit allows the error signal to control the gate of the heavy-load transistor through the gate control circuit.

2. The linear voltage regulator according to claim 1, wherein:

when the detection current signal is smaller than the threshold current signal, the mode selection circuit prevents the error signal from controlling the gate of the heavy-load transistor through the gate control circuit.

3. The linear voltage regulator according to claim 2, wherein:

when the detection current signal is smaller than the threshold current signal, the mode selection circuit causes the gate of the heavy-load transistor to be coupled to the input voltage through the gate control circuit.

4. The linear voltage regulator according to claim 1, wherein:

the heavy-load transistor has a current driving capability larger than that of the light-load transistor.

5. The linear voltage regulator according to claim 1, wherein:

the heavy-load transistor has a dimension larger than that of the light-load transistor.

6. The linear voltage regulator according to claim 1, wherein:

the gate control circuit includes a first transmission gate and a second transmission gate, which are controlled by the mode selection circuit such that when the first transmission gate is made conductive, the input voltage controls the gate of the heavy-load transistor through the first transmission gate, and when the second transmission gate is made conductive, the error signal controls the gate of the heavy-load transistor through the second transmission gate.

7. The linear voltage regulator according to claim 6, wherein:

when the detection current signal is smaller than the threshold current signal, the mode selection circuit makes the first transmission gate conductive.

8. The linear voltage regulator according to claim 6, wherein:

when the detection current signal is larger than the threshold current signal, the mode selection circuit makes the second transmission gate conductive.

9. The linear voltage regulator according to claim 1, wherein:

the mode selection circuit includes:

a current sensing unit for generating the detection current signal, and a current comparing unit for comparing the detection current signal and the threshold current signal.

10. The linear voltage regulator according to claim 9, wherein:

the current comparing unit is implement by a current comparator having a hysteresis effect.

* * * * *

UNITED STATES PATENT AND TRADEMARK OFFICE

CERTIFICATE OF CORRECTION

PATENT NO. : 7,106,032 B2
APPLICATION NO. : 10/906093
DATED : September 12, 2006
INVENTOR(S) : Chen et al.

It is certified that error appears in the above-identified patent and that said Letters Patent is hereby corrected as shown below:

On the title page: Item [54] should read -- HIGH-EFFICIENCY LINEAR VOLTAGE REGULATOR. --

Signed and Sealed this

Twenty-seventh Day of February, 2007

JON W. DUDAS
*Director of the United States Patent and Trademark Office*